US008667940B2

(12) United States Patent
Melecosky et al.

(10) Patent No.: US 8,667,940 B2
(45) Date of Patent: Mar. 11, 2014

(54) ENGINE ASSEMBLY INCLUDING VALVETRAIN LUBRICATION SYSTEM

(75) Inventors: Jason C. Melecosky, Oxford, MI (US); Timothy L. Neal, Ortonville, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 296 days.

(21) Appl. No.: 13/211,754

(22) Filed: Aug. 17, 2011

(65) Prior Publication Data

US 2013/0042826 A1 Feb. 21, 2013

(51) Int. Cl.
*F01M 1/06* (2006.01)

(52) U.S. Cl.
USPC ..... 123/90.33; 123/90.12; 123/90.13; 123/90.16; 123/90.34

(58) Field of Classification Search
USPC ..... 123/90.12, 90.13, 90.16, 90.33, 90.34
See application file for complete search history.

(56) References Cited

U.S. PATENT DOCUMENTS

| | | | | |
|---|---|---|---|---|
| 5,195,474 | A * | 3/1993 | Urata et al. | 123/90.12 |
| 5,709,186 | A * | 1/1998 | Taue | 123/196 W |
| 6,899,070 | B2 | 5/2005 | Neal | |
| 7,162,996 | B2 * | 1/2007 | Yang | 123/321 |

OTHER PUBLICATIONS

Vasilash, Gary S., Automotive Design Production—Powertrain: Designing, Engineering and Producing, Field Guide for Automotive Management, Mar./Apr. 2011, 2 pages.

* cited by examiner

*Primary Examiner* — Ching Chang
(74) *Attorney, Agent, or Firm* — Harness, Dickey & Pierce, P.L.C.

(57) ABSTRACT

An engine assembly includes an engine block, a cylinder head coupled to the engine block and first and second lubrication systems. The first lubrication system includes a first pump in communication with the engine block and providing a first fluid to the engine block. The second lubrication system is isolated from the first lubrication system and includes a second pump in communication with the cylinder head and providing a second fluid to the cylinder head.

7 Claims, 5 Drawing Sheets

ENGINE ASSEMBLY INCLUDING VALVETRAIN LUBRICATION SYSTEM

FIELD

The present disclosure relates to engine oil systems, and more specifically to valvetrain lubrication systems.

BACKGROUND

This section provides background information related to the present disclosure which is not necessarily prior art.

Internal combustion engines may combust a mixture of air and fuel in cylinders and thereby produce drive torque. Intake and exhaust valves control air flow to and from the engine cylinders. Oil may be provided to the cylinder head from the engine block to lubricate the valvetrain components.

SUMMARY

An engine assembly may include an engine block, a cylinder head coupled to the engine block and first and second lubrication systems. The first lubrication system may include a first pump in communication with the engine block and providing a first fluid to the engine block. The second lubrication system may be isolated from the first lubrication system and may include a second pump in communication with the cylinder head and providing a second fluid to the cylinder head.

In another arrangement, an engine assembly may include an engine structure defining a cylinder bore, a first valve supported by the engine structure and in communication with the cylinder bore, a second valve supported by the engine structure and in communication with the cylinder bore, a hydraulic valve actuation mechanism and a mechanical valvetrain assembly. The hydraulic valve actuation mechanism may include an inlet in communication with a pressurized fluid and engaged with the first valve to control displacement of the first valve between an open position and a closed position. The mechanical valvetrain assembly may be engaged with the second valve and in communication with the pressurized fluid from an outlet of the hydraulic valve actuation mechanism.

Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only and are not intended to limit the scope of the present disclosure in any way.

Corresponding reference numerals indicate corresponding parts throughout the several views of the drawings.

DETAILED DESCRIPTION

Figure 1:
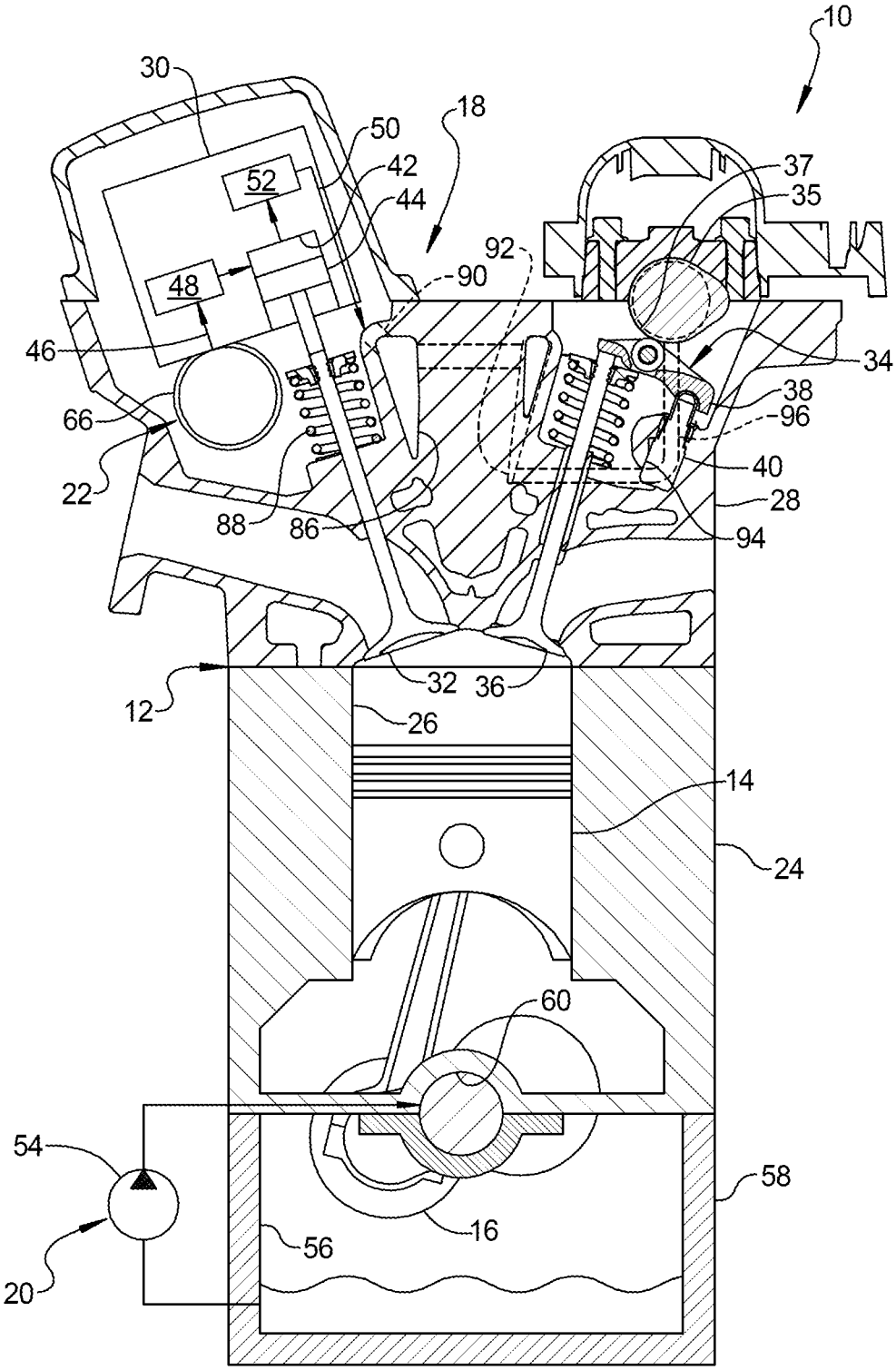
FIG. 1 is a partially schematic section view of an engine assembly according to the present disclosure.

Examples of the present disclosure will now be described more fully with reference to the accompanying drawings. The following description is merely exemplary in nature and is not intended to limit the present disclosure, application, or uses.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

When an element or layer is referred to as being "on," "engaged to," "connected to" or "coupled to" another element or layer, it may be directly on, engaged, connected or coupled to the other element or layer, or intervening elements or layers may be present. In contrast, when an element is referred to as being "directly on," "directly engaged to," "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

An engine assembly 10 is illustrated in FIGS. 1-4 and may include an engine structure 12, pistons 14, a crankshaft 16 coupled to the pistons 14, a valvetrain assembly 18 and first and second lubrication systems 20, 22. The engine structure 12 may include an engine block 24 defining cylinder bores 26 housing the pistons 14 and a cylinder head 28 coupled to the engine block 24.

The valvetrain assembly 18 will be described relative to a single cylinder bore 26 of the engine assembly 10 for simplicity. The valvetrain assembly 18 may include a hydraulic valve actuation mechanism 30 supported on the cylinder head 28 and engaged with a first valve 32 and a mechanical valve lift mechanism 34 supported on the cylinder head 28 and engaged with a second valve 36. The valvetrain assembly 18 may additionally include a camshaft 35 supported for rotation on a cam bearing region 37 of the cylinder head 28 and engaged with the mechanical valve lift mechanism 34 and a cam phaser 39 coupled to the camshaft 35 and rotationally driven by the crankshaft 16. In the non-limiting example illustrated in FIGS. 1-4, the cam phaser 39 is a hydraulically actuated cam phaser. However, it is understood that a variety of alternate cam phasers may be used including, but not limited to, a magnetic cam phaser 139 as seen in FIG. 5.

In the present non-limiting example, the first valve 32 is an intake valve, the second valve 36 is an exhaust valve, and the mechanical valve lift mechanism 34 is a rocker arm 38 supported for pivotal displacement on a hydraulic lash adjuster 40. The camshaft 35, rocker arm 38 and hydraulic lash adjuster 40 form a mechanical valvetrain assembly. A simplified hydraulic valve actuation mechanism 30 is schematically illustrated for simplicity and includes a housing defining a fluid chamber 42 housing a piston 44 engaged with the first valve 32, a fluid inlet 46 selectively in communication with the fluid chamber 42 via a first control valve 48 and a fluid outlet 50 selectively in communication with the fluid chamber 42 via a second control valve 52.

The first lubrication system 20 may include a first pump 54 in communication with a fluid reservoir 56 containing a first fluid and passages defined by the engine block 24. More specifically, the fluid reservoir 56 may include an engine oil pan 58 and the first fluid may include engine oil. The first pump 54 may provide the engine oil to main bearings 60 rotationally supporting the crankshaft 16. The second lubrication system 22 may provide a second fluid to the valvetrain assembly 18. The second lubrication system 22 may be isolated from the first lubrication system 20 and the second fluid may be different from the first fluid. By way of non-limiting example, the second fluid may include engine oil having a greater density than the first fluid.

Figure 2:
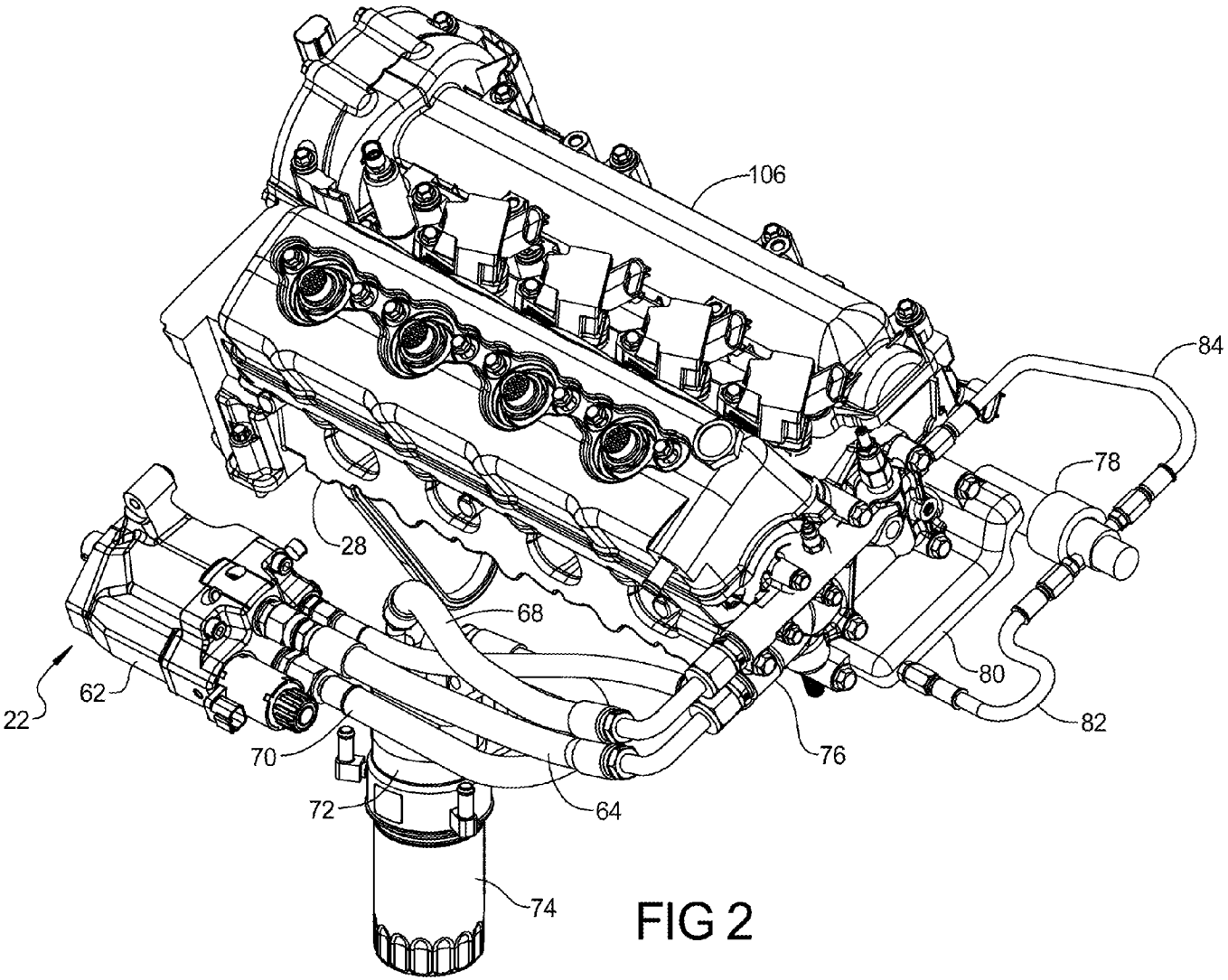
FIG. 2 is a perspective view of a portion of the engine assembly of FIG. 1.
Figure 3:
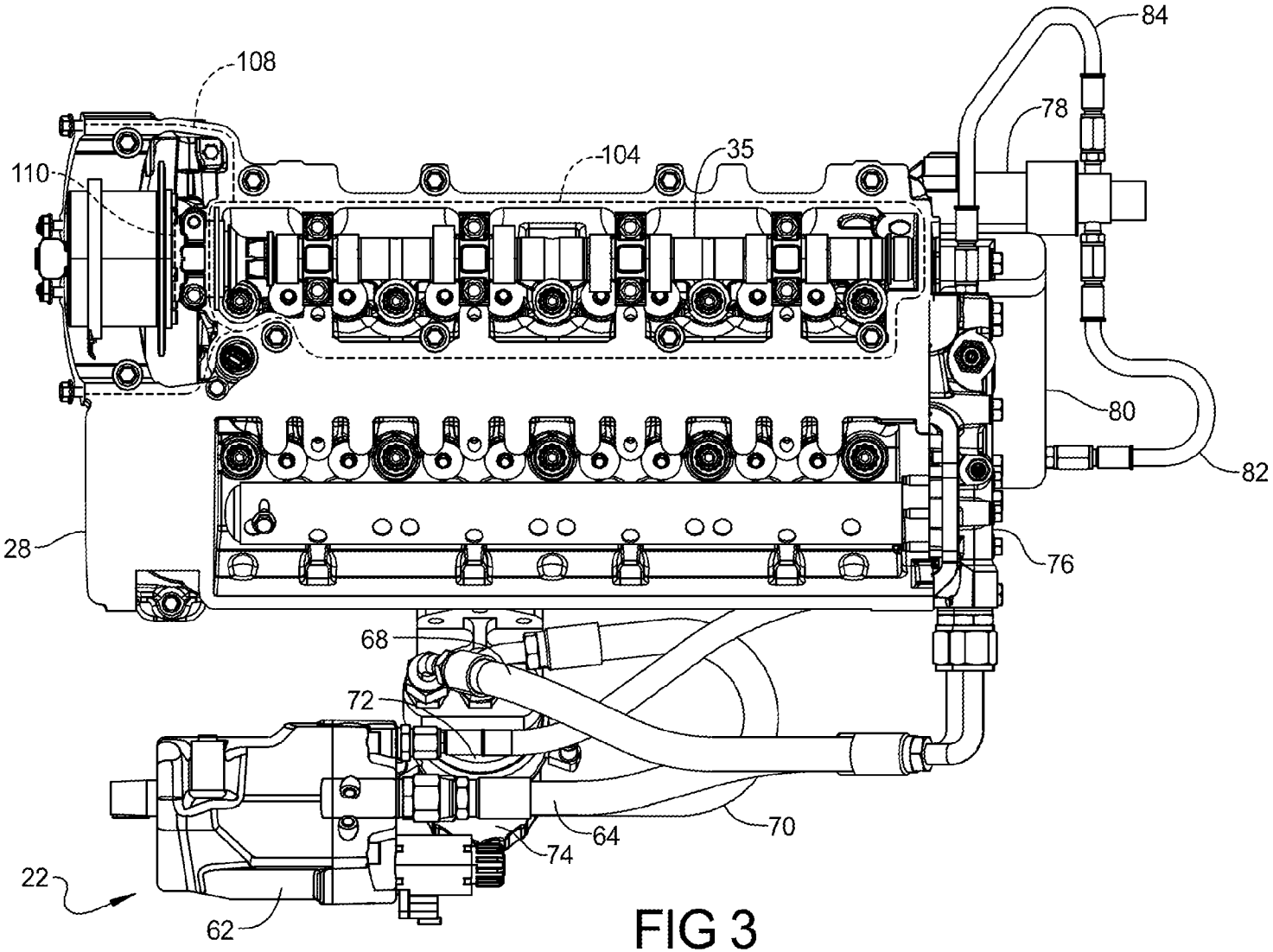
FIG. 3 is a top view of the engine assembly shown in FIG. 2 illustrating the fluid flow path to the cylinder head and valvetrain components.

As seen in FIGS. 2 and 3, the second lubrication system 22 may include a second pump 62, a supply line 64, a supply rail 66 (FIGS. 1 and 4) in communication with the fluid inlet 46 of the hydraulic valve actuation mechanism 30, a first return line 68, a second return line 70, an oil cooler 72, an oil filter 74, a fluid manifold 76, a lift pump 78, a fluid reservoir 80 and first and second lift pump lines 82, 84. The second pump 62 may form a high pressure oil pump in communication with the cylinder head 28.

The second lubrication system 22 may from a closed loop system with a pump outlet of the second pump 62 providing pressurized fluid (second fluid) to the supply rail 66 via the supply line 64 and the fluid manifold 76. A pump inlet of the second pump 62 may receive the second fluid after the second fluid passes through the valvetrain assembly 18.

During engine operation, the first control valve 48 may allow communication between the pressurized second fluid from the supply rail 66 via the fluid inlet 46 and the fluid chamber 42 to selectively displace the first valve 32 to an open position. The first valve 32 may be displaced to a closed position by closing the first control valve 48 and opening the second control valve 52.

The fluid outlet 50 may be in communication with a pressurized fluid reservoir 86 defined in the cylinder head. When the second control valve 52 is in the open position, the fluid chamber 42 may be in communication with the pressurized fluid reservoir 86 via the fluid outlet 50 and the valve spring 88 may displace the first valve 32 to a closed position, exhausting the second fluid within the fluid chamber 42 to the pressurized fluid reservoir 86 via a first passage 90 defined in the cylinder head 28. The second fluid within the supply rail 66 may be at a first operating pressure and the second fluid within the pressurized fluid reservoir 86 may be at a second operating pressure less than the first operating pressure. The first operating pressure may be at least ten times the second operating pressure. By way of non-limiting example, the second operating pressure may remain at least five hundred kilopascal (500 kPa) within the pressurized fluid reservoir 86 and the first operating pressure may be greater than five thousand kilopascal (5,000 kPa).

The cylinder head 28 may define a second passage 92 from the pressurized fluid reservoir 86 to a hydraulic lash adjuster bore 94 housing the hydraulic lash adjuster 40 and a third passage 96 in communication with the pressurized fluid reservoir 86 (via the second passage 92) and the cam bearing region 37. The second fluid exiting the second and third passages 92, 96 may ultimately be collected in the fluid reservoir 80. The fluid reservoir 80 may contain the second fluid at approximately atmospheric pressure.

Figure 4:
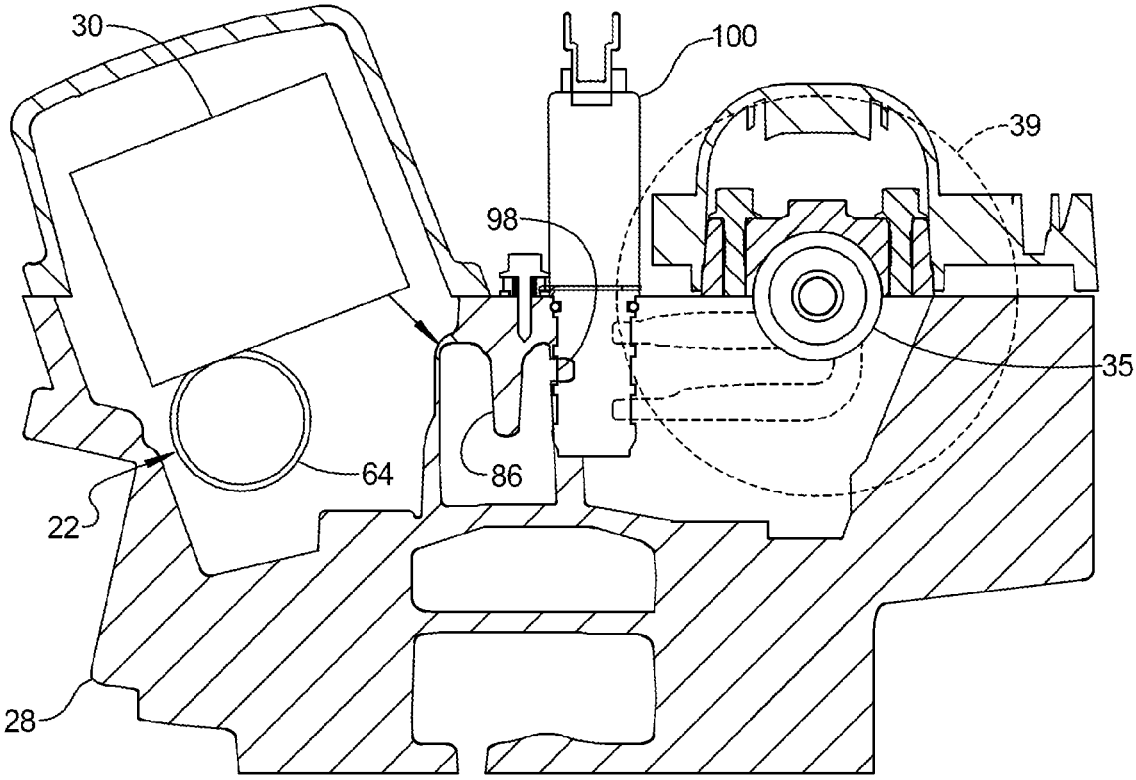
FIG. 4 is an additional partially schematic section view of the cylinder head shown in FIG. 1.
Figure 5:
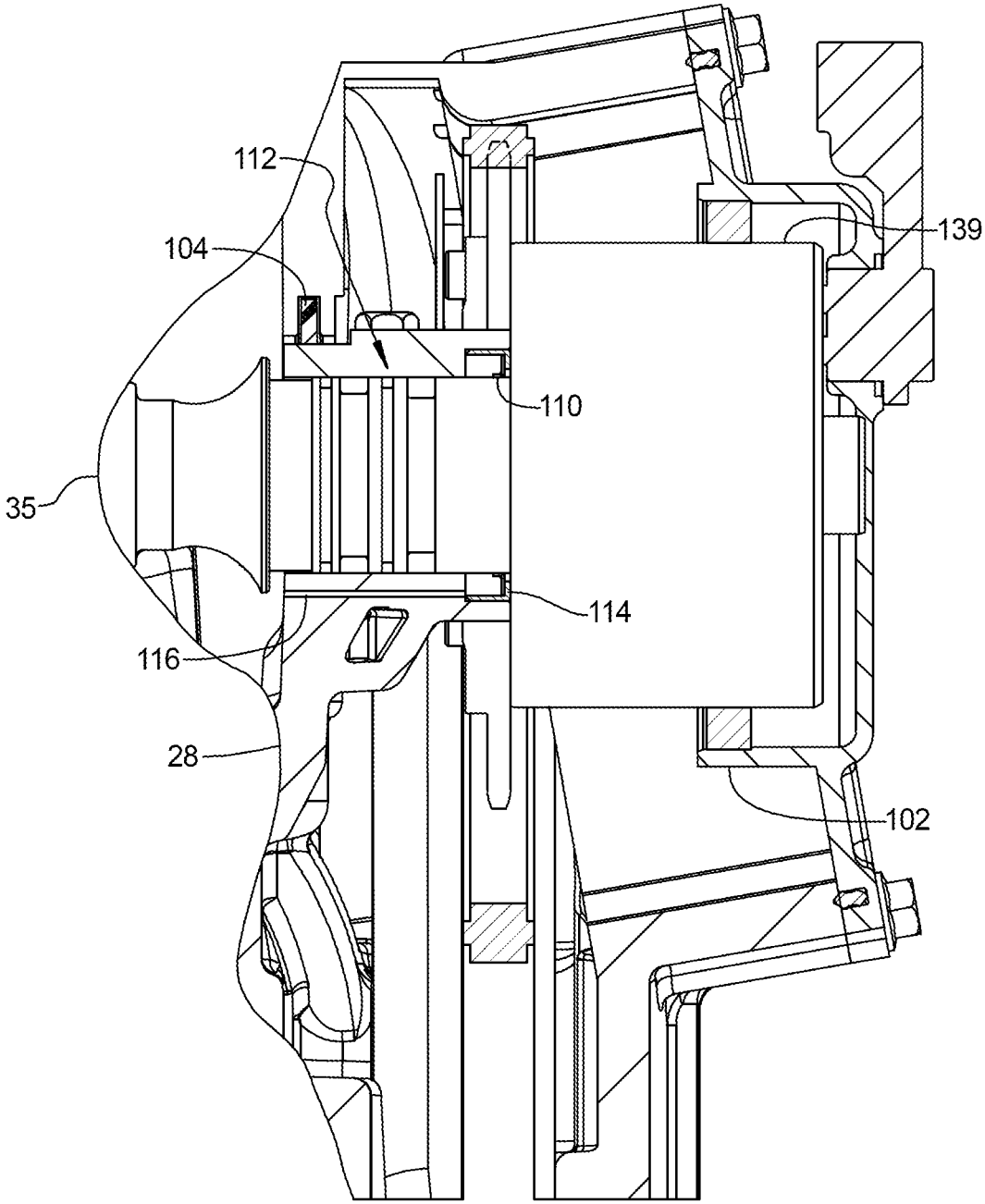
FIG. 5 is fragmentary section view of an alternate valvetrain arrangement according to the present disclosure including a magnetic cam phaser.

As seen in FIG. 4, the cylinder head 28 may additionally define a fourth passage 98 in communication with an oil control valve (OCV) 100 located in the cylinder head 28. The OCV 100 may be in communication with the cam phaser 39 and may selectively provide the second fluid from the pressurized fluid reservoir 86 to advance or retard the rotational position of the camshaft 35. The OCV 100 may additionally be in communication with the fluid reservoir 80 and may exhaust the second fluid from the cam phaser 39 to the fluid reservoir during actuation of the cam phaser 39.

The lift pump 78 may draw the second fluid from the fluid reservoir 80 and pump the second fluid to the fluid manifold 76 and ultimately return the second fluid to the second pump 62. The return flow path from the fluid manifold 76 to the second pump 62 may include the second fluid travelling from the fluid manifold 76 to the oil cooler 72 and oil filter 74 via the first return line 68 and then to the second pump 62 via the second return line 70.

As indicated above and seen in FIG. 5, the magnetic cam phaser 139 may be coupled to the camshaft 35 in place of the hydraulic cam phaser 39. In either arrangement, cam phaser 139 (or cam phaser 39) may be located in a chain drive cavity 102 exposed to the first lubrication system 20. Therefore, the cam phaser 139 (or cam phaser 39) may be located external to a region of the cylinder head 28 in communication with the second lubrication system 22.

As schematically illustrated in FIG. 3, a first seal 104 may be engaged with the cylinder head 28 and a cam cover 106 (FIG. 2) at a region surrounding the camshaft 35 and a second seal 108 may be engaged with the cylinder head 28 and the cam cover 106 at a region surrounding the chain drive cavity 102 to isolate the first and second lubrication systems 20, 22 from one another. FIG. 5 includes a partial section view including a portion of the cam phaser 139 cut away to illustrate a third seal 110 further isolating the first and second lubrication systems 20, 22 from one another.

The third seal 110 may form an annular lip seal located in an annular recess defined by the cylinder head 28 and a cam bearing cap 112. An L-shaped bracket 114 may be fixed within the annular recess defined by the cylinder head 28 and the cam bearing cap 112 and the third seal 110 may be engaged with the bracket 114 and an outer circumference of the camshaft 35 to further isolate the first and second lubrication systems 20, 22 from one another. A passage 116 may be located in the cylinder head 28 and may extend from the annular recess defined by the cylinder head 28 and the cam bearing cap 112 to a region of the second lubrication system 22 to allow trapped oil to drain back to the second lubrication system 22.

What is claimed is:

1. An engine assembly comprising:

an engine block;

a cylinder head coupled to the engine block;

a first lubrication system including a first pump in communication with the engine block and providing a first fluid to the engine block; and a second lubrication system isolated from the first lubrication system and including a second pump in communication with the cylinder head and providing a second fluid to the cylinder head, further comprising a first valve supported by the cylinder head, a second valve supported by the cylinder head, a hydraulic valve actuation mechanism in communication with the second lubrication system for receiving the second fluid from the second pump at a first operating pressure and engaged with the first valve and operable to displace the first valve between open and closed positions, a camshaft supported on the cylinder head, a mechanical valve lift mechanism engaged with the second valve and the camshaft and operable to displace the second valve between open and closed positions, wherein the cylinder head defines a first pressurized fluid reservoir in communication with the fluid outlet of the hydraulic valve actuation mechanism and for supplying the second fluid at a second operating pressure lower than the first pressure to the mechanical valve lift mechanism to lubricate the mechanical valve lift mechanism with the second fluid exiting the hydraulic valve actuation mechanism.

2. The engine assembly of claim 1, wherein the first operating pressure is at least 10 times the second operating pressure.

3. The engine assembly of claim 1, further comprising a hydraulically actuated cam phaser in communication with a fluid outlet of the hydraulic valve actuation mechanism.

4. The engine assembly of claim 1, further comprising a crankshaft rotationally supported by the engine block and a cam phaser coupled to the camshaft and rotationally driven by the crankshaft, the cam phaser being located external to a region of the cylinder head in communication with the second lubrication system and located in a region of the engine assembly exposed to the first lubrication system, the first and second lubrication systems being isolated from one another by a seal engaged with the camshaft and the cylinder head.

5. The engine assembly of claim 1, wherein the first fluid is different from the second fluid.

6. The engine assembly of claim 1, further comprising the second fluid being collected in a second fluid reservoir after lubrication of the mechanical valve lift mechanism and the second fluid reservoir being in communication with a pump inlet of the second pump.

7. The engine assembly of claim 6, wherein the first valve includes an intake valve and the second valve includes an exhaust valve.

* * * * *